US011746553B1

(12) United States Patent
Donner et al.

(10) Patent No.: US 11,746,553 B1
(45) Date of Patent: Sep. 5, 2023

(54) TELESCOPIC TRAVEL HEIGHT TRUSS

(71) Applicant: CW10K40 LLC, Camden, DE (US)

(72) Inventors: William P. Donner, Howard, SD (US); Robert W. Donner, Desmet, SD (US); Riley J. Schwader, Howard, SD (US); Torsten Leines, Maple Grove, MN (US)

(73) Assignee: CW10K40 LLC, Paracorp Incorporated, Camden, DE (US)

( * ) Notice: Subject to any disclaimer, the term of this patent is extended or adjusted under 35 U.S.C. 154(b) by 0 days.

(21) Appl. No.: 17/490,067

(22) Filed: Sep. 30, 2021

Related U.S. Application Data

(60) Provisional application No. 63/085,682, filed on Sep. 30, 2020.

(51) Int. Cl.
*E21B 19/15* (2006.01)
*E04H 12/34* (2006.01)

(52) U.S. Cl.
CPC ..... *E04H 12/345* (2013.01); *E21B 19/155* (2013.01)

(58) Field of Classification Search
CPC ..... E21B 19/15; E21B 19/155; E21B 19/14; E21B 19/16; E21B 19/20
See application file for complete search history.

(56) References Cited

U.S. PATENT DOCUMENTS

| | | | | |
|---|---|---|---|---|
| 2,958,430 | A | 11/1960 | Robishaw | |
| 3,684,198 | A | 8/1972 | Pallmann et al. | |
| 4,024,957 | A | 5/1977 | Schleis | |
| 4,386,883 | A * | 6/1983 | Hogan | E21B 19/155 414/22.61 |
| 7,077,209 | B2 | 7/2006 | McCulloch et al. | |
| 7,163,367 | B2 * | 1/2007 | Handley | E21B 19/155 414/745.9 |
| 8,998,551 | B2 * | 4/2015 | Guillory, Jr. | E21B 19/155 384/42 |
| 9,863,193 | B2 | 1/2018 | Buchanan | |
| 10,584,541 | B2 | 3/2020 | Reddy et al. | |
| 10,626,687 | B1 * | 4/2020 | Jeseritz | E21B 19/155 |
| 10,662,725 | B1 * | 5/2020 | Morelli | E21B 19/155 |
| 10,738,545 | B2 * | 8/2020 | Clarke | E21B 19/155 |
| 10,851,601 | B2 | 12/2020 | Keast et al. | |
| 2006/0104746 | A1 | 5/2006 | Thompson | |
| 2009/0185883 | A1 | 7/2009 | Wright et al. | |
| 2013/0251491 | A1 * | 9/2013 | Ludwig | B66F 11/00 414/745.8 |

(Continued)

*Primary Examiner* — Lynn E Schwenning
(74) *Attorney, Agent, or Firm* — Dicke, Billig & Czaja, PLLC

(57) ABSTRACT

Aspects of the disclosure relate to an apparatus having a travel height truss including a frame suitable for transporting an item. The apparatus includes a boom which may be raised from the frame. The boom is raised and lowered by a hydraulic system comprising a travel height truss. The travel height truss may comprise two portions, telescopically connected to each other, one portion pivotably connected to the frame and the other pivotably connected to the boom. The travel height truss provides greater leverage than would otherwise be available for the maximum size and weight of the load available for a given (fixed) maximum length of trailer. In this manner, the boom frame can be raised to greater heights, while maintaining horizontal distance, than otherwise.

10 Claims, 14 Drawing Sheets

(56) References Cited

U.S. PATENT DOCUMENTS

| | | | | |
|---|---|---|---|---|
| 2013/0269268 | A1 | 10/2013 | Thiessen et al. | |
| 2013/0302114 | A1 | 11/2013 | Reddy et al. | |
| 2020/0247488 | A1* | 8/2020 | Leines | E21B 19/155 |

* cited by examiner

TELESCOPIC TRAVEL HEIGHT TRUSS

CROSS-REFERENCE TO RELATED APPLICATIONS

This Non-Provisional Patent Application claims the benefit of the filing date of U.S. Provisional Patent Application Ser. No. 63/085,682, filed Sep. 30, 2020, entitled "TELESCOPIC TRAVEL HEIGHT TRUSS," which is herein incorporated by reference.

BACKGROUND

Drilling rigs are known and used for identifying geologic reservoirs of natural resources, such as oil, for example, and also to create holes that allow the extraction of natural resources from those reservoirs. The extraction process begins by positioning the drilling rig over the site to be drilled. Drilling rigs can be mobile and driven from site to site or can also be more permanent structures positioned over the drilling site.

The process begins by drilling a hole deep into the Earth. A long drill bit attached to a section of "drilling string" is used for this purpose. After each section is drilled, a steel pipe slightly smaller than the hole diameter is dropped in and often cement is used to fill the outer gap. The steel pipe is called a casing and provides structural integrity to the drilled hole. As the drill bit progresses deeper, additional sections of pipe need to be added to the drilling string to allow the drill bit to move further into the Earth. Typically, workers standing on the drilling rig take the additional sections of pipe, one by one, and screw them onto the drilling string, as needed. The additional sections of pipe are delivered to the site and then raised one by one to the workers with a crane.

The present disclosure addresses problems and limitations with the related art.

SUMMARY

Aspects of the disclosure relate to an apparatus having a trailer height truss including a frame for supporting and transporting a section of pipe or other item. In one example, the apparatus is a transportable trailer. Generally, the apparatus includes a boom, which may be raised from the frame and used to move the pipe to or from the trailer to a work site, storage or other location. For example, index arms may move the section of pipe from a ground storage rack to the boom, where a skate may push the section of pipe along the length of the boom toward the rig. Or, the section of pipe may be moved from the rig to the boom, where the skate allows controlled downward movement of the section of pipe to where the section of pipe may be moved from the boom back onto ground storage racks. The boom is raised and lowered by a hydraulic system comprising the travel height truss. The travel height truss may comprise two portions, telescopically connected to each other, one portion pivotably connected to the frame and the other pivotably connected to the boom. Two independently controllable hydraulic systems control the motion of the travel height truss. The travel height truss provides greater leverage to the boom than would otherwise be available for the maximum size and weight of the boom available for a given (fixed) maximum length of the apparatus. This allows the boom to reach higher rig heights while maintaining a horizontal distance from the rig.

Embodiments of the disclosure are particularly useful for raising booms used to lift pipe sections used in oil drilling.

In such embodiments, the frame can optionally be driven to a job site, and the boom extended to its full height to enable movement of the pipe sections or other items up or down the boom. Embodiments of the disclosure provide a safe and stable, yet more versatile apparatus because they permit the boom to raise the pipe sections to greater heights, while maintaining horizontal distance, than an apparatus or trailer without the inventive features.

In one aspect, the disclosure provides a trailer comprising a trailer height truss including a frame having opposing first and second sides as well as an axle supporting a plurality of wheels. The trailer includes a boom which may be raised from the trailer and used to move the pipe from the trailer to a storage or other location. The boom is raised and lowered by a hydraulic system comprising a travel height truss. The travel height truss may comprise two portions, telescopically connected to each other, one portion pivotably connected to the frame and the other pivotably connected to the boom. Two independently controllable hydraulic systems control the motion of the travel height truss. One system is internally connected between each of the two portions of the travel height truss, and the other cylinder is pivotably connected between one of the portions and the frame of the trailer. Either or both hydraulic systems may comprise one, or multiple, hydraulic cylinders.

In a specific aspect, the disclosure provides a trailer comprising a trailer frame and a travel height truss including an outer truss having first and second ends and comprising two outer hollow rails. The outer truss may be pivotably connected to the trailer frame at the first end such that expansion of a lift cylinder causes the second end of the outer truss to pivot upwardly with respect to the trailer frame. An inner height carriage, slidingly positioned within the outer truss, has a top side and a bottom side. At least one ultrahigh molecular weight (UHMW) slide may be fastened to (or otherwise provided to) at least one of the top and bottom sides of the inner height carriage to reduce sliding friction between the outer truss and the inner height carriage. At least one height cylinder having two ends may be located within the outer truss and pinned on one of its ends to the outer truss and on the other of its ends to the inner height carriage. Hydraulic expansion of the height cylinder causes the inner height carriage to telescopically or slidingly extend outwardly from the outer truss.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. Like reference numerals designate corresponding similar parts.

DETAILED DESCRIPTION

In the following detailed description, reference is made to the accompanying drawings, which form a part hereof, and in which is shown by way of illustration specific embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Any apparatus disclosed herein may be provided without wheels (commonly called a "skid") or may be wheeled (commonly called a "trailer"). Solely for convenience, one illustrative wheeled apparatus or trailer 10 is collectively illustrated in the figures, but it should be understood that the apparatus does not depend on the presence of wheels. In that sense, the term "trailer" should be understood to include a skid unless specifically indicated otherwise.

As shown in the figures, and particularly referring to FIGS. 1 and 2A-2C, the trailer 10 optionally includes a hitch 12 for securing to a vehicle (not shown), such as a truck, as well as a frame 14 interconnected to the hitch 12. The frame 14 can take a variety of forms, as desired, and supports an item to be transported. As shown in FIGS. 1 and 2A-2C, frame 14 has various loads omitted solely for clarity of illustration.

Figure 1:
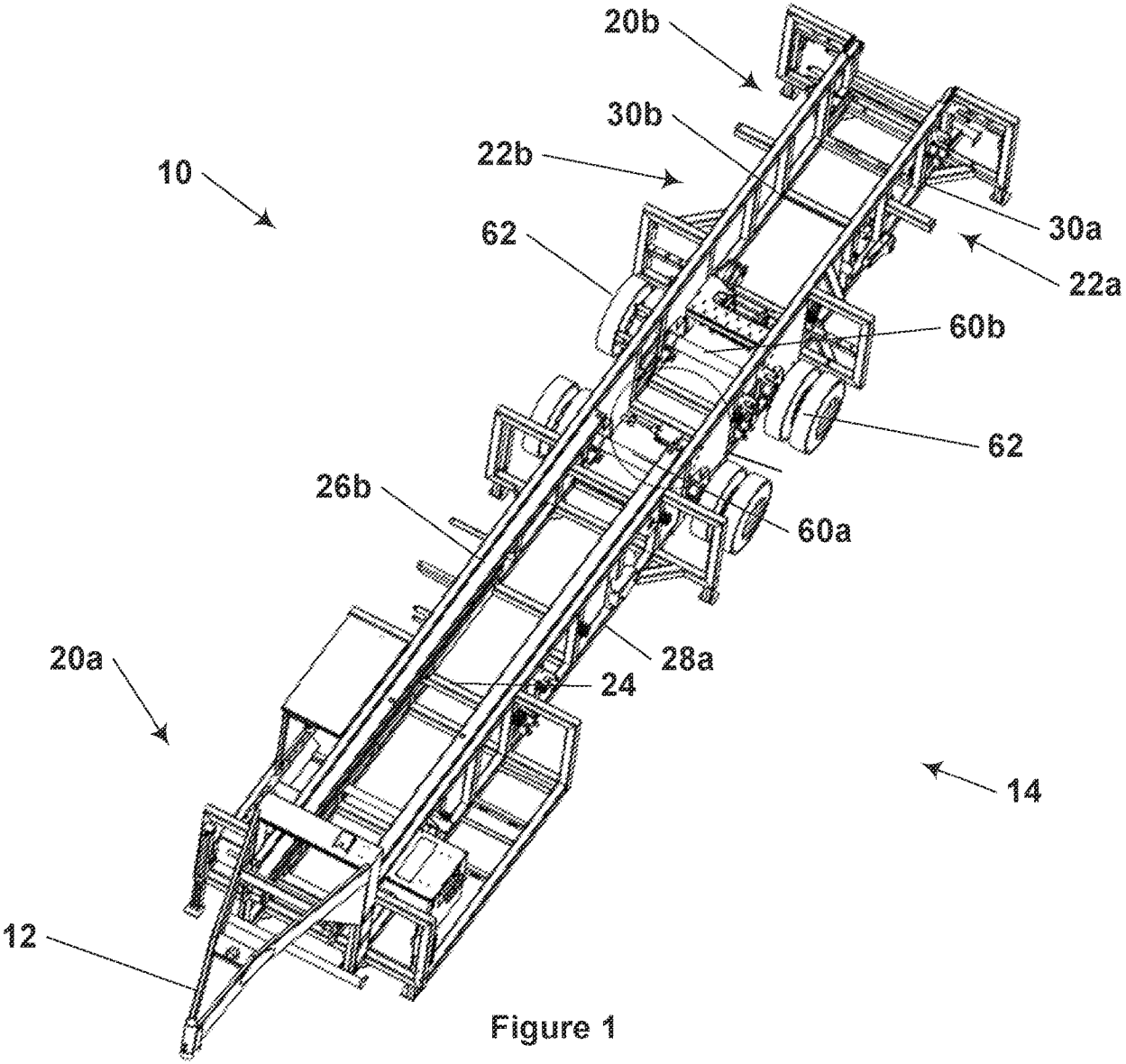
FIG. 1 is a perspective view of a frame of an apparatus or trailer of the disclosure.
Figure 2A:
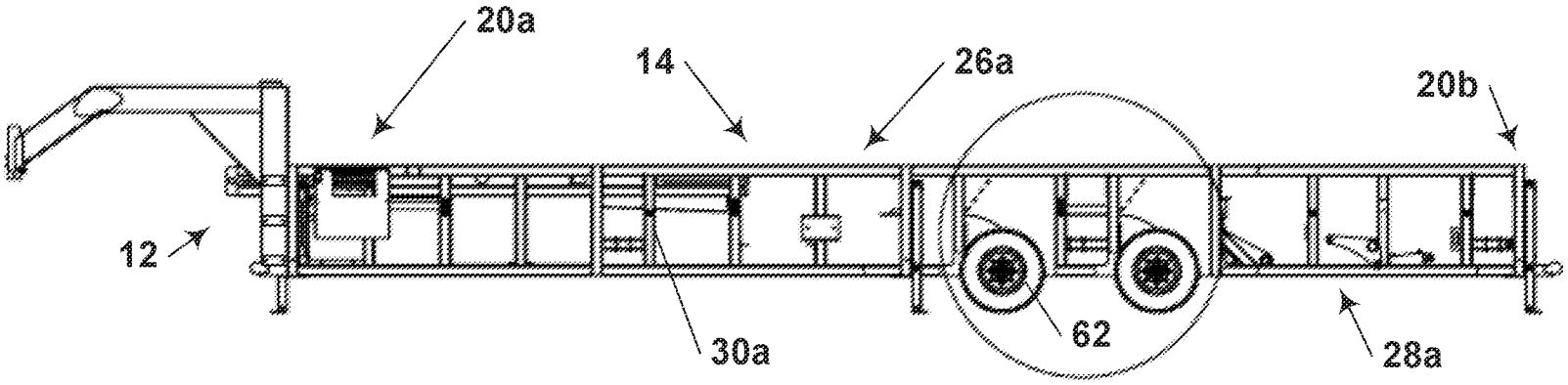
FIG. 2A is a side view of the trailer depicted in FIG. 1.
Figure 2B:
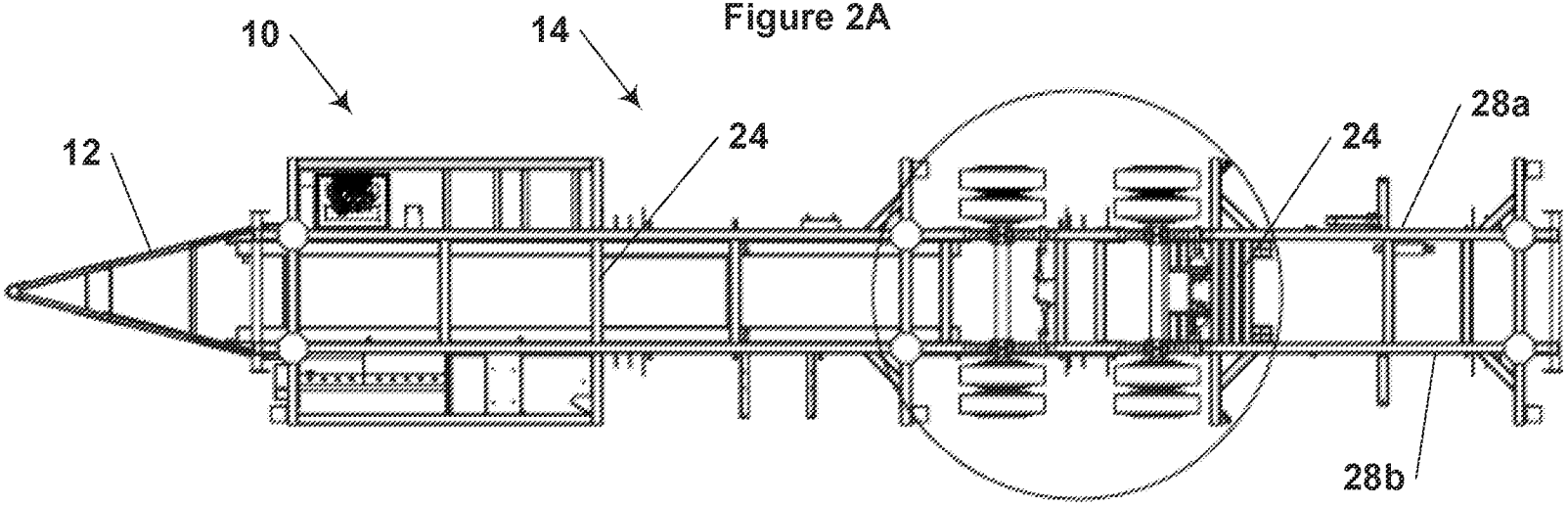
FIG. 2B is a bottom view of the frame of the trailer depicted in FIG. 1.
Figure 2C:
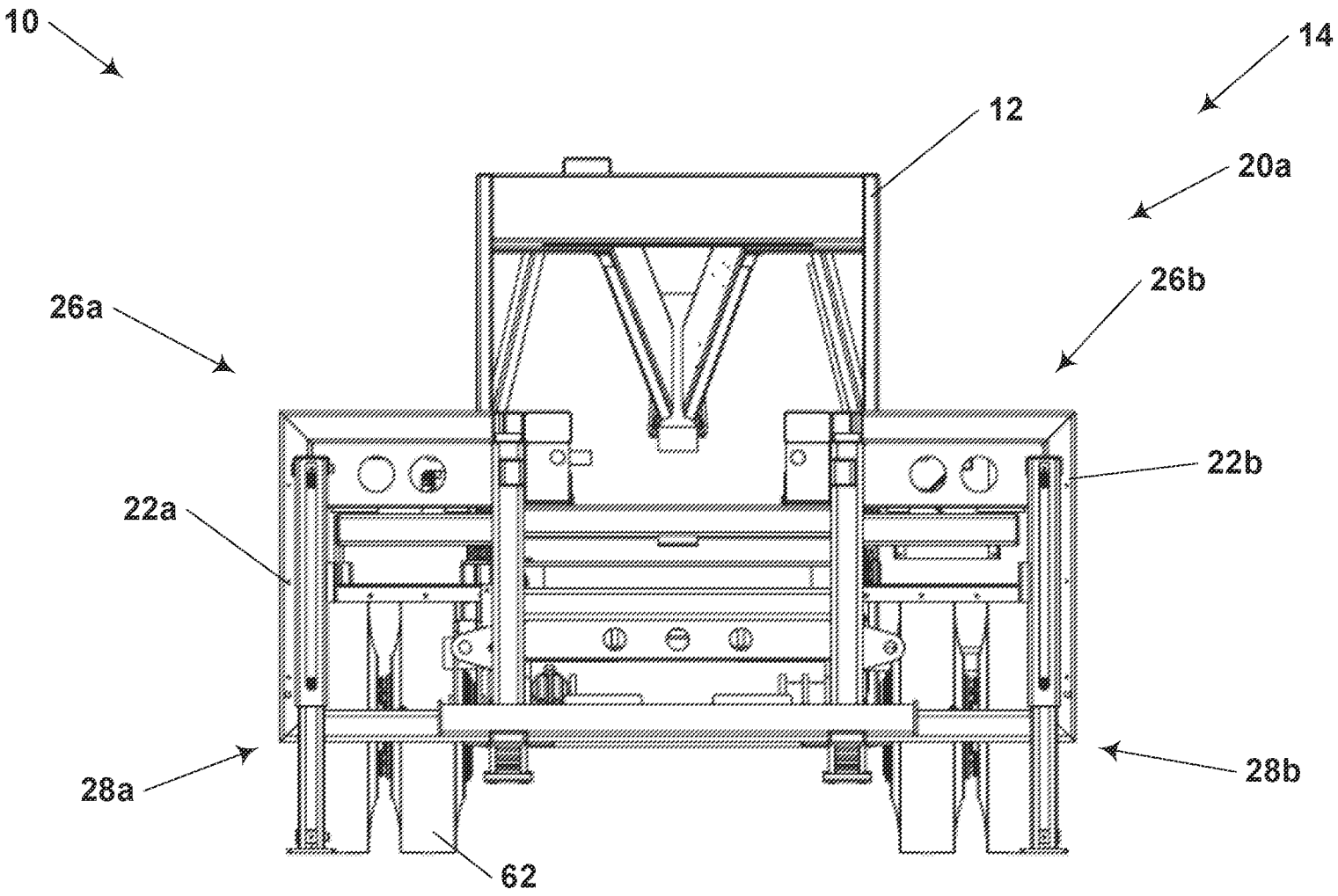
FIG. 2C is an end view of the frame of the trailer depicted in FIGS. 1 and 2A-2B.
Figure 3A:
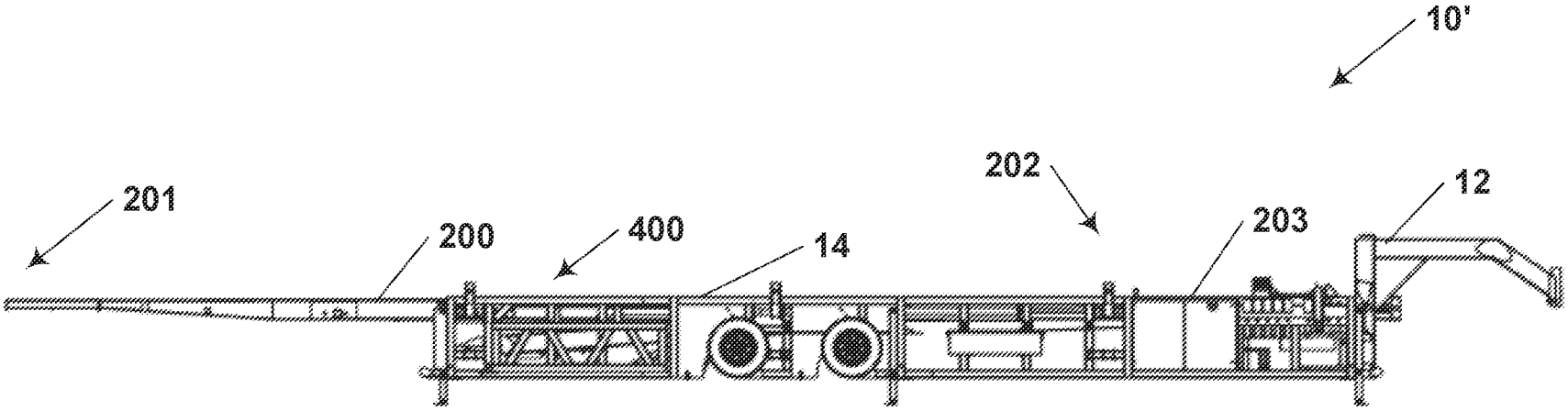
FIGS. 3A, 3B and 3C are side views of an apparatus including the frame of the trailer of FIGS. 1-2C on which a trailer height truss supporting a boom is shown in alternative positions according to the disclosure.
Figure 3B:
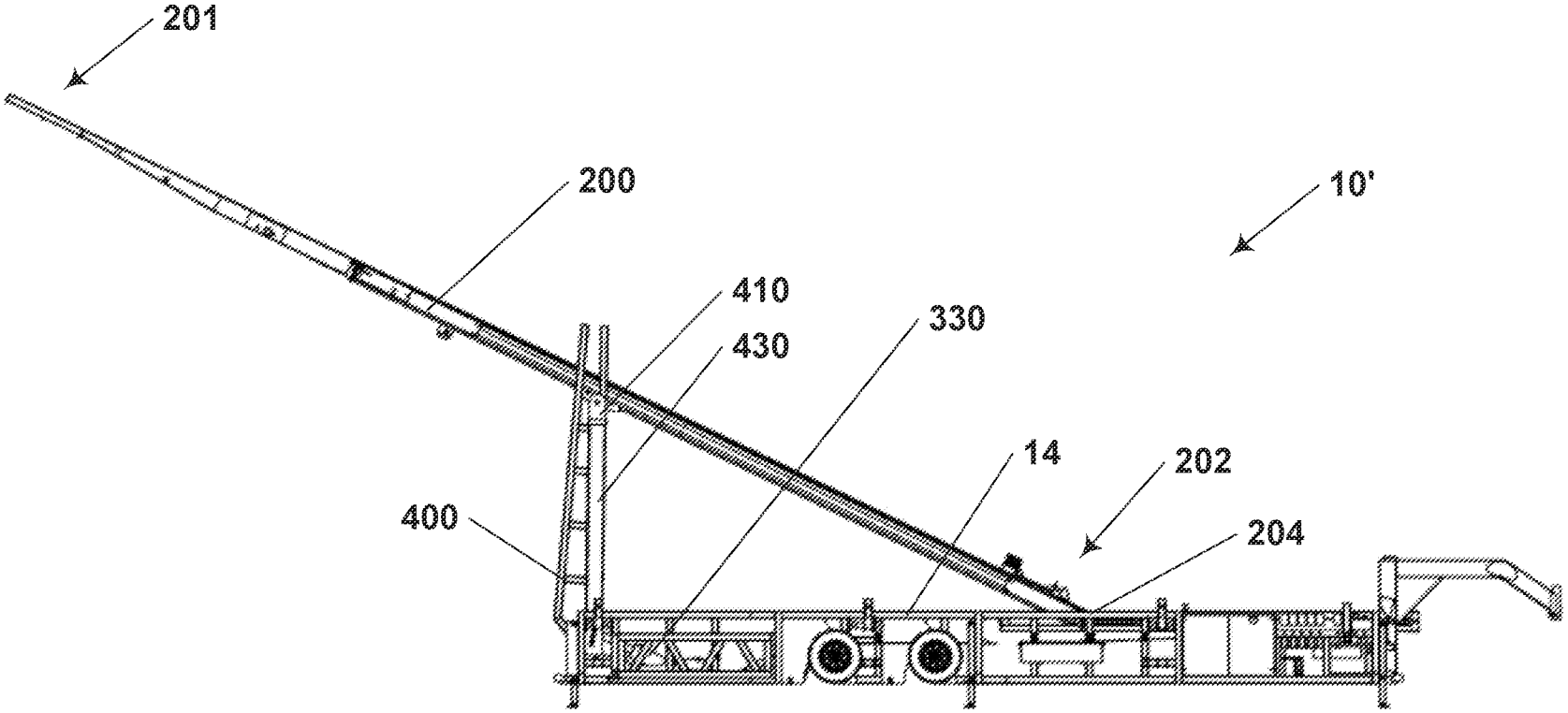
Figure 3C:
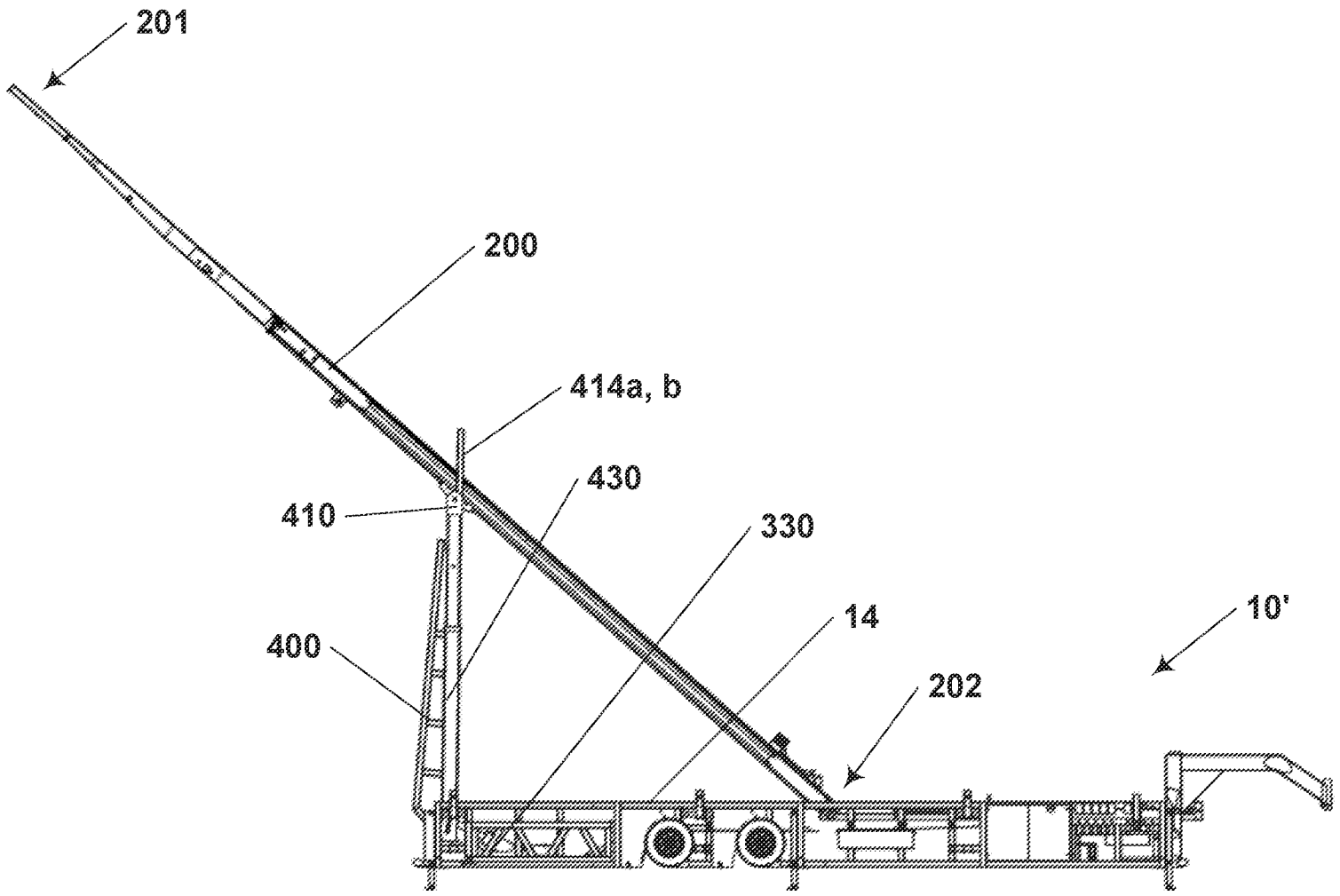

In one example, the item to be transported is a boom 200 usable to lift generally cylindrical pipe sections suitable for oil drilling (see also, e.g., pipe section P in FIG. 3C). In one example, the pipe section P may have a length in the range of 20 to 60 feet. In one example, the pipe section P may have an outer diameter in the range of % to 30 inches. The frame 14 can, for example, include first and second ends 20*a*, 20*b*, first and second sides 22*a*, 22*b*, and multiple bottom supports 24 spanning the first and second sides 22*a*, 22*b*. Each side 22*a*, 22*b* can include a top 26*a*, 26*b* and a bottom 28*a*, 28*b* and include multiple vertical supports 30*a*, 30*b* spanning the respective top 26*a*, 26*b* and bottom 28*a*, 28*b*. It is noted that only a few representative horizontal supports 24 and vertical supports 30*a*, 30*b* are referenced for ease of illustration. The present disclosure, however, is not intended to be limited to any particular configuration of frame 14.

As illustrated (only by way of example because wheels are not required), interconnected to the frame 14 is at least one axle 60*a*, 60*b* operatively supporting at least one wheel 62 on opposing sides 22*a*, 22*b* of the frame 14 (e.g., four wheels connected to each axle 60*a* 60*b*, two on each side 22*a*, 22*b* of the frame 14). The wheels 62 can be any type commonly used for trailers, trucks or the like. In the illustrated embodiment, the trailer 10 includes first and second axles 60*a*, 60*b*, each axle 60*a*, 60*b* supporting two wheels 62 on opposite sides 22*a*, 22*b* of the frame 14.

Referring now in addition to FIGS. 3A-3C, 4A-4C, and 5A-5D, trailer 10' supports the boom 200. Generally, boom 200 is telescopically or otherwise extendable to a length longer than that of a length of the frame 14, but this is not required. Such extension may be accomplished by any convenient means not critical to this disclosure. Further details of one extendable embodiment of the boom may be found in U.S. application Ser. No. 16/263,592 filed Jan. 31, 2019, copending, the disclosure of which is hereby incorporated by reference in its entirety. It is noted that the trailer 10' is identical to trailer 10 except as explicitly stated.

In general, boom 200 is mounted to frame 14 so that a first portion 201 of boom 200 may be elevated substantially above trailer 10' and frame 14, while a second portion 202 remains generally in place vertically. In various examples, boom 200 is moved in a two-step sequence. In one example, the boom 200 is 40 feet with a 15 foot extension. In one example, a first stage of boom lift height is 30 feet and a second stage of boom lift height is sixty feet.

First, to increase the angle above vertical which boom 200 may make with the generally horizontal plane of the frame 14, and thus increase the height to which the first portion 201 may reach for a given length of boom 200, the second portion 202 both pivots about an axis transverse to the length of frame 14, and translates from a forward position 203 to a rearward position 204. In addition, boom 200 is elevated from the frame 14 by the action of a travel height truss 400. Like boom 200 itself, travel height truss 400 is mounted to frame 14 so that travel height truss 400 may pivot above frame 14. Second, to further increase the height to which the first portion 201 may reach for a given length of boom 200, the travel height truss 400 telescopically expands to a greater height above frame 14. Specifically, inner height carriage 410 extends from within outer truss 430 to rise vertically above the horizontal plane of frame 14. Thus, travel height truss 400 pivots upward and then extends in length with the ultimate objective of lifting the highest point (i.e. first portion 201) of boom 200 as high as possible. To lower the boom 200, the process is reversed to lower the travel height truss 400.

Figure 4A:
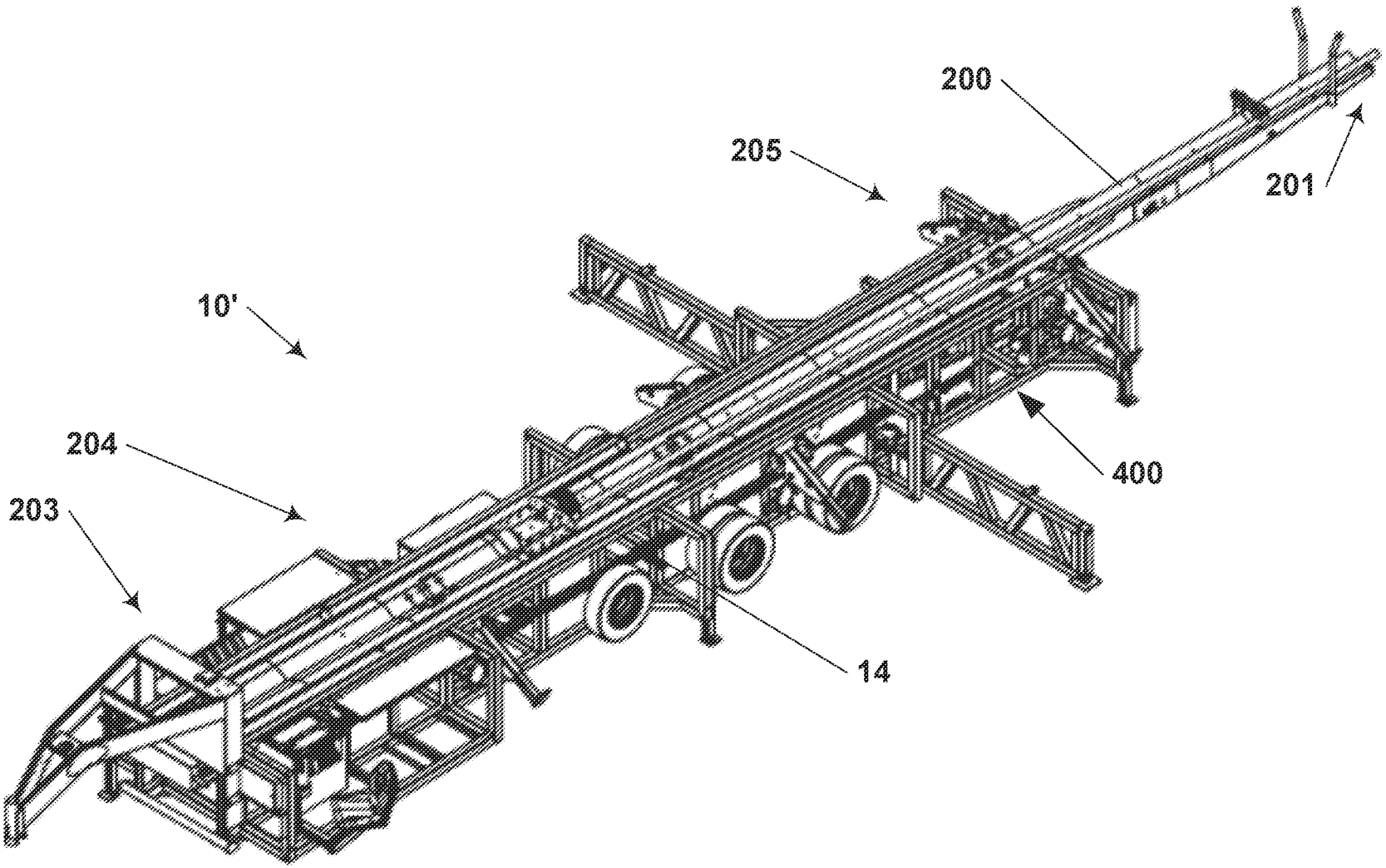
FIGS. 4A, 4B and 4C are perspective views of the apparatus of FIGS. 3A-3C depicted in alternative positions.
Figure 4B:
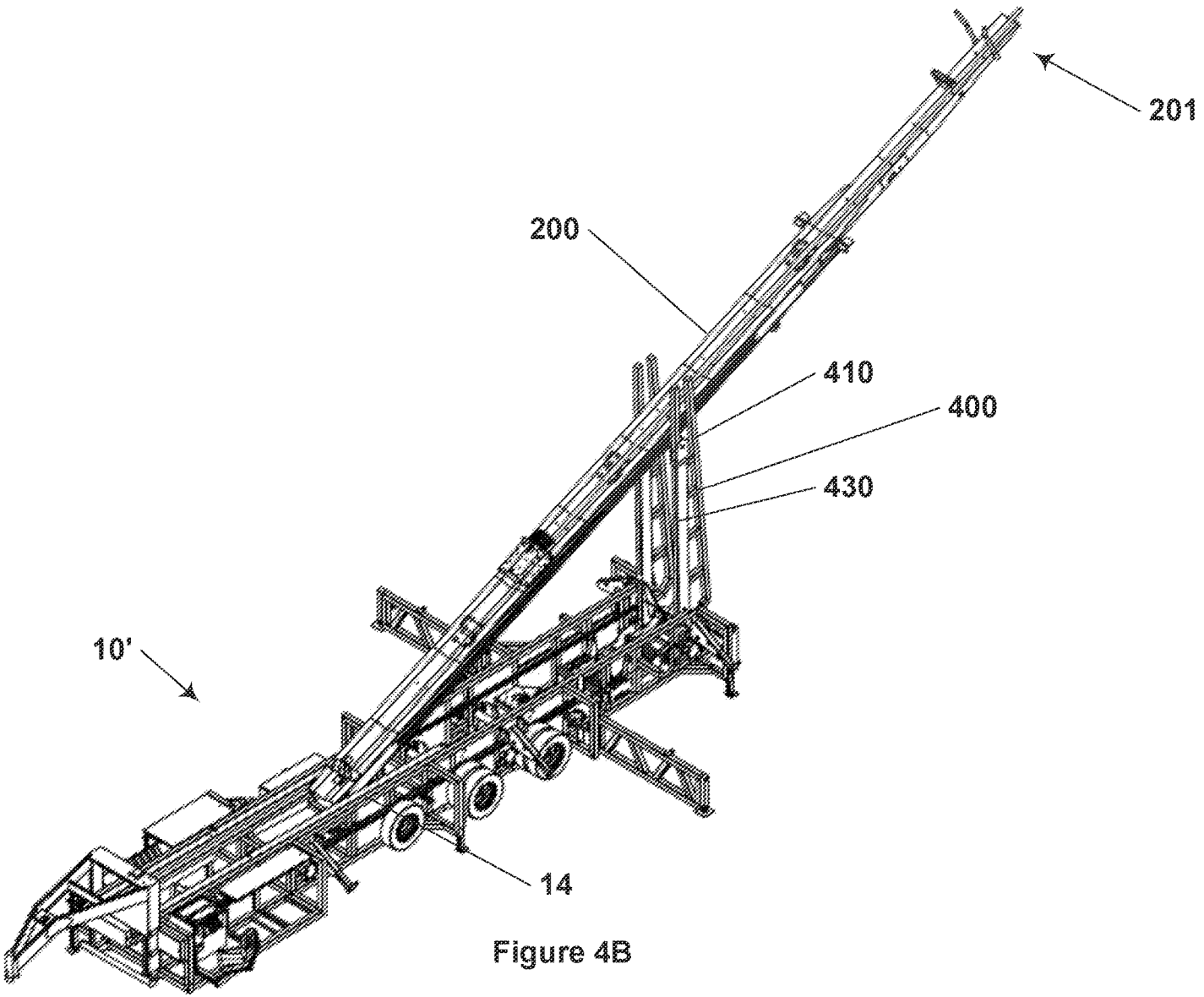
Figure 4C:
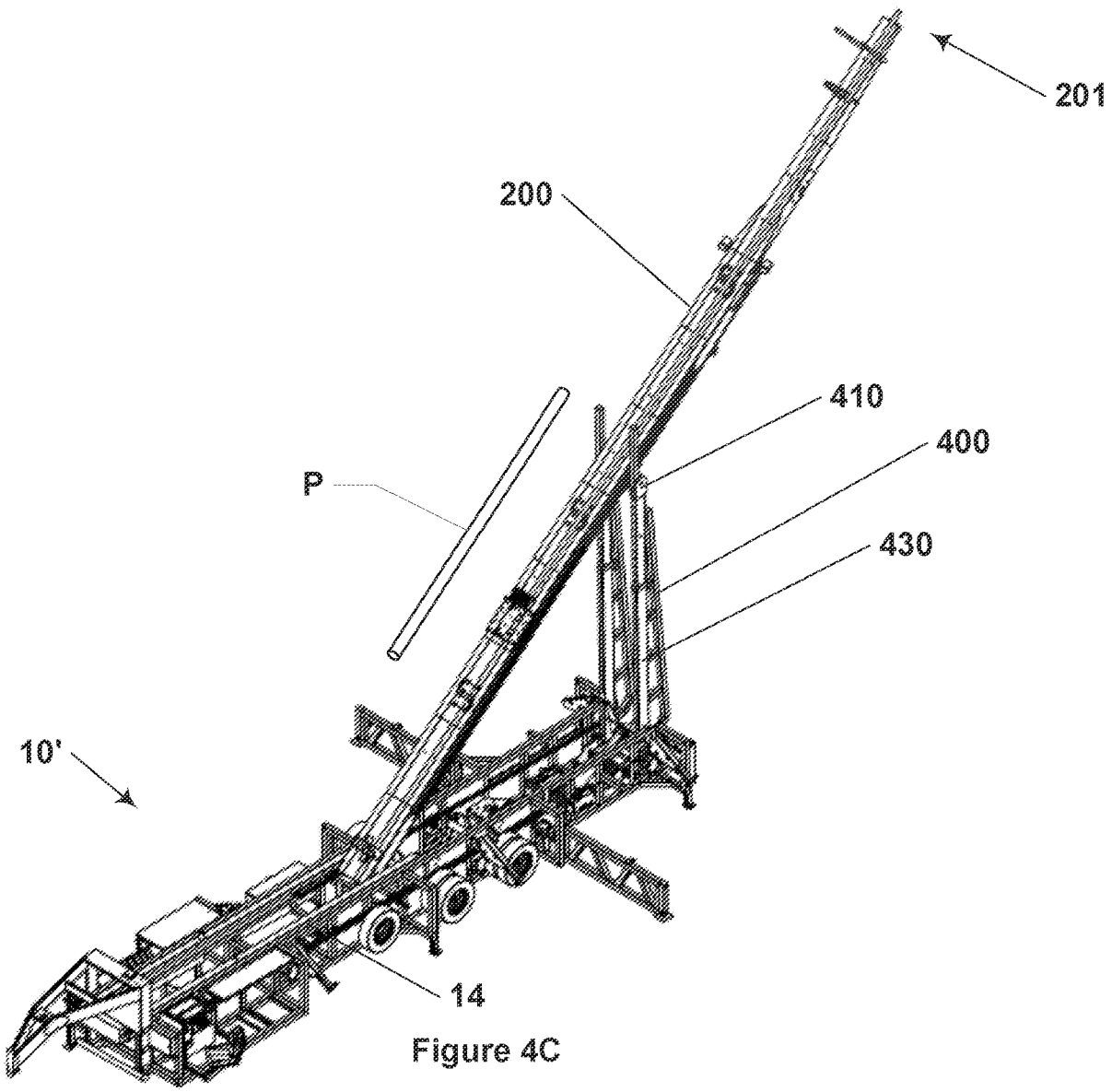
Figure 5C:
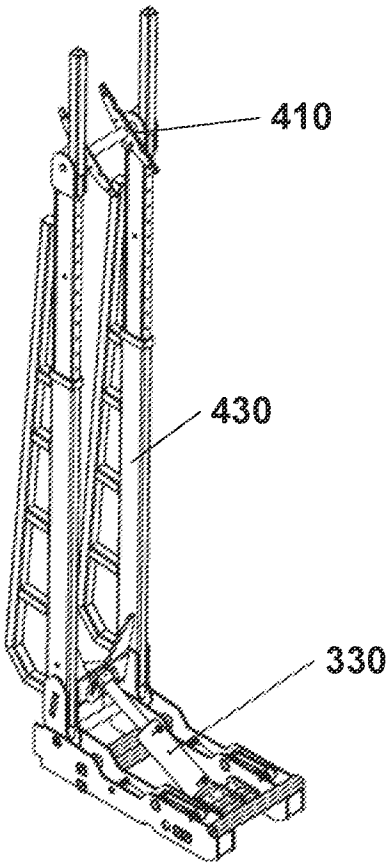
FIGS. 5A, 5B, and 5C are perspective views of a portion of the apparatus depicted in the respective alternative positions of FIGS. 3A-3C and 4A-4C.
Figure 5B:
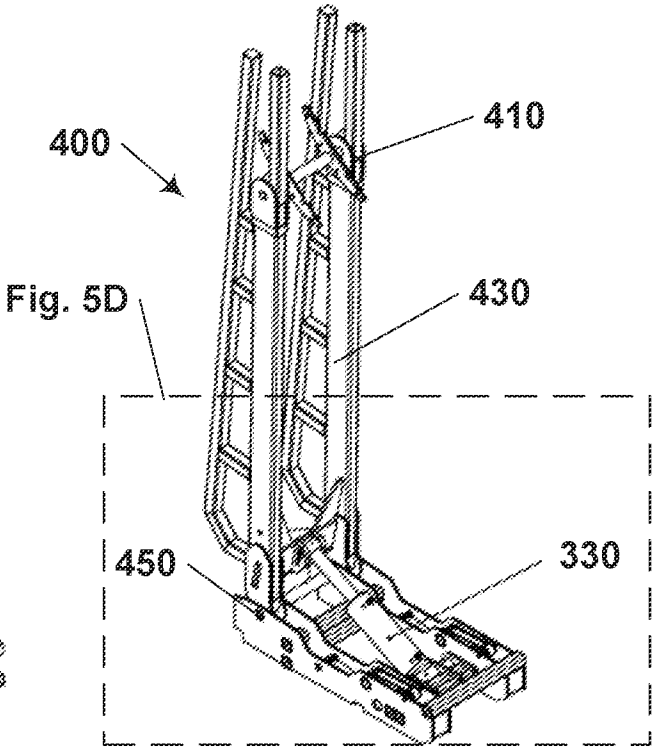
Figure 5A:
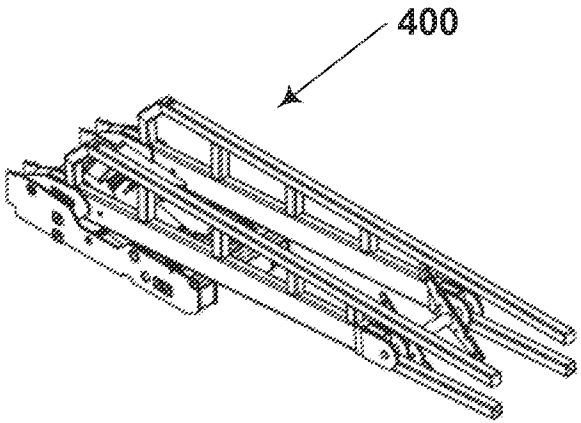

As shown specifically in FIGS. 3A-3B, 4A-4B, and 5A-5B, the first stage of elevation is accomplished by hydraulic lift cylinder 330 arranged to cause travel height truss 400 to move relative to frame 14, specifically to pivot about hinge 450. Considering FIGS. 3A, 4A, and 5A, in the position shown there the boom 200 is in its rest or lowered position. The boom 200 is extended as far forward along frame 14 as possible. The travel height truss 400 on which the boom rests is also in its rest or lowered position (FIG. 5A). The lift cylinder 330 is fully retracted. Then, in the position illustrated in FIGS. 3B, 4B, and 5B, the boom 200 is in an intermediate position between its rest or lowered position and its maximum extended position. Boom 200 has travelled along a conventional track (not illustrated for clarity) from its maximum forward position toward the rear of frame 14. As compared to the position shown in FIGS. 3A, 4A, and 5A, lift cylinder 330 has fully extended, causing travel height truss 400 to pivot to an essentially vertical orientation as shown in FIGS. 3B, 4B, and 5B. In the essentially vertical orientation, the boom 200 defines an angle of 25 degrees with respect to frame 14.

Figure 5D:
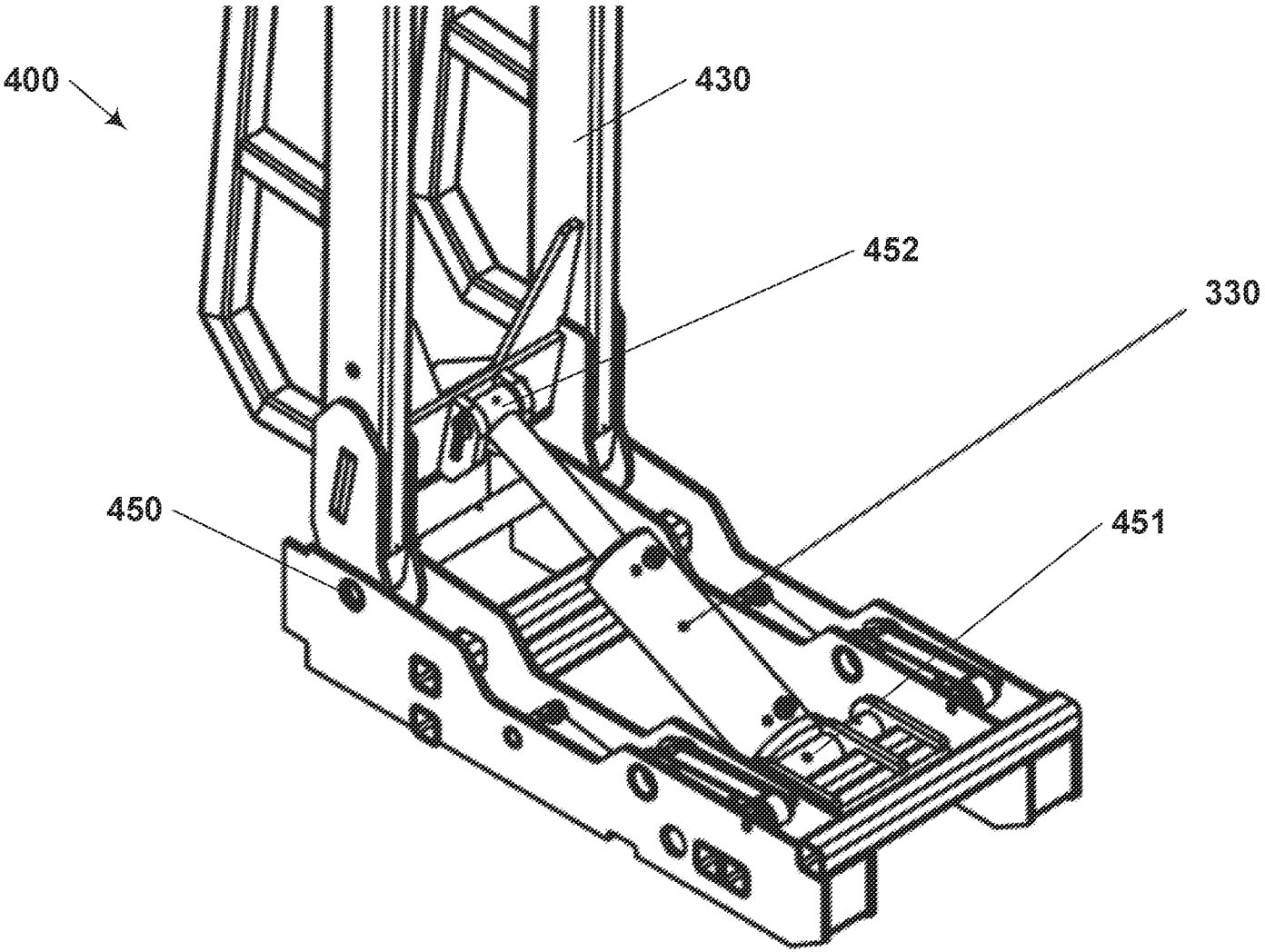
FIG. 5D is an enlarged view of a portion of FIG. 5B.
Figure 6A:
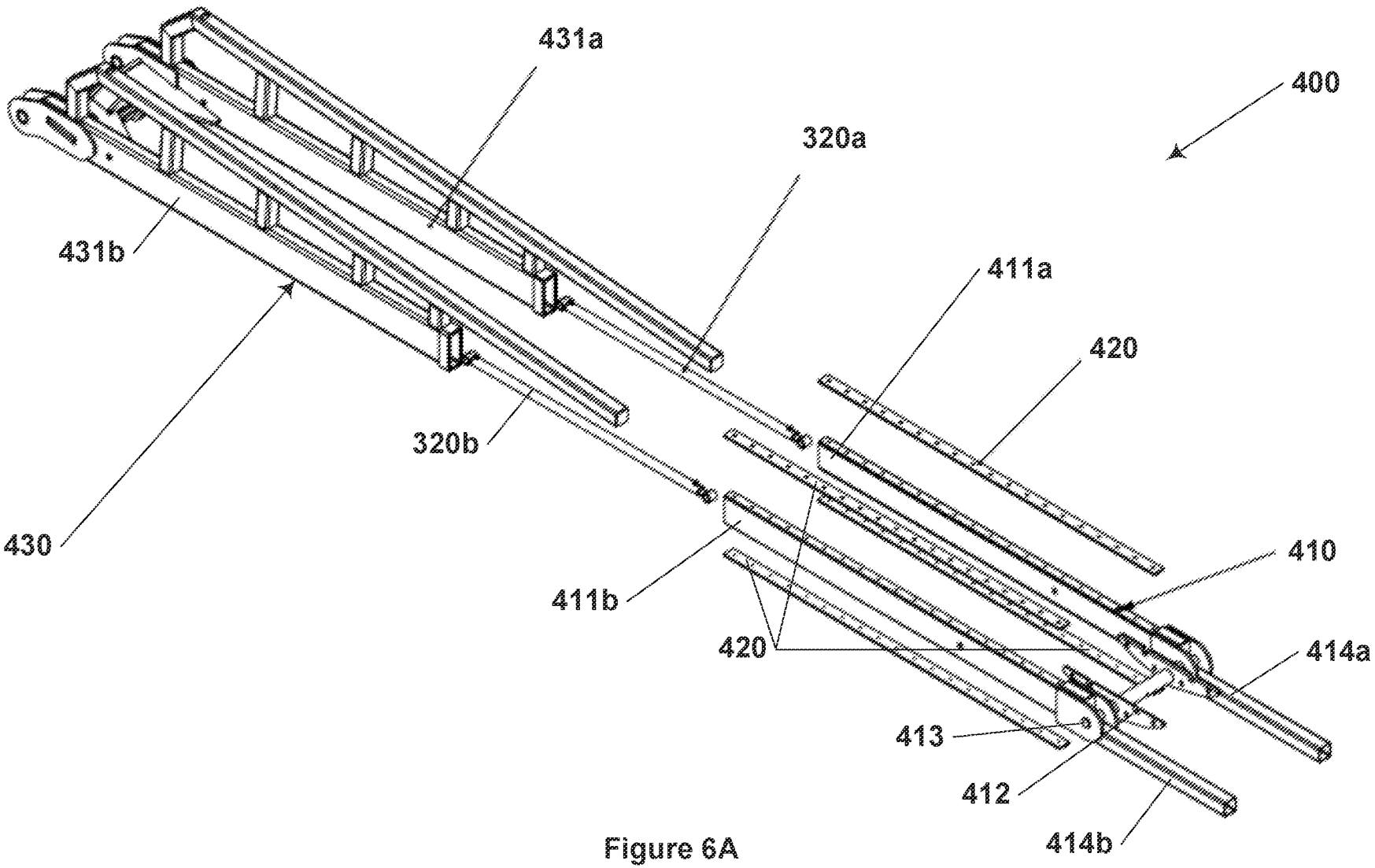
FIGS. 6A, 6B, 6C, and 6D are various views of select components of the apparatus of FIGS. 3A-5D according to the disclosure in various configurations.
Figure 6B:
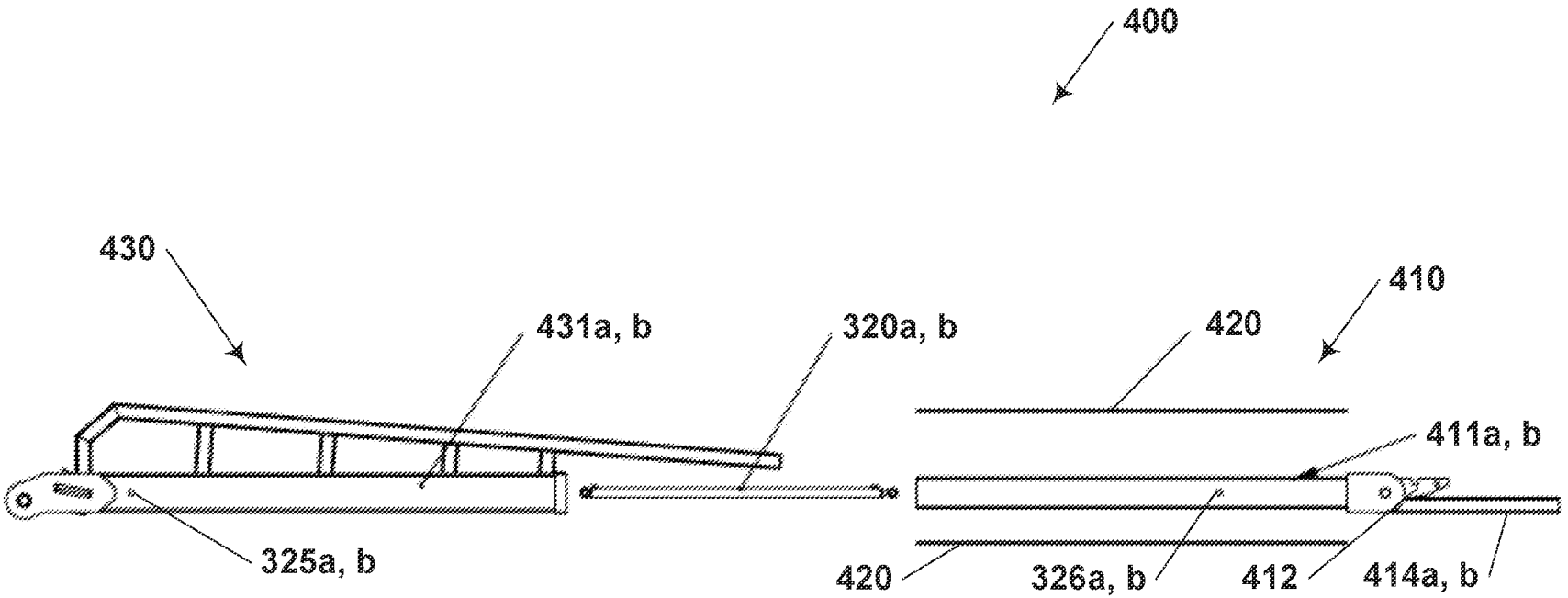
Figure 6C:
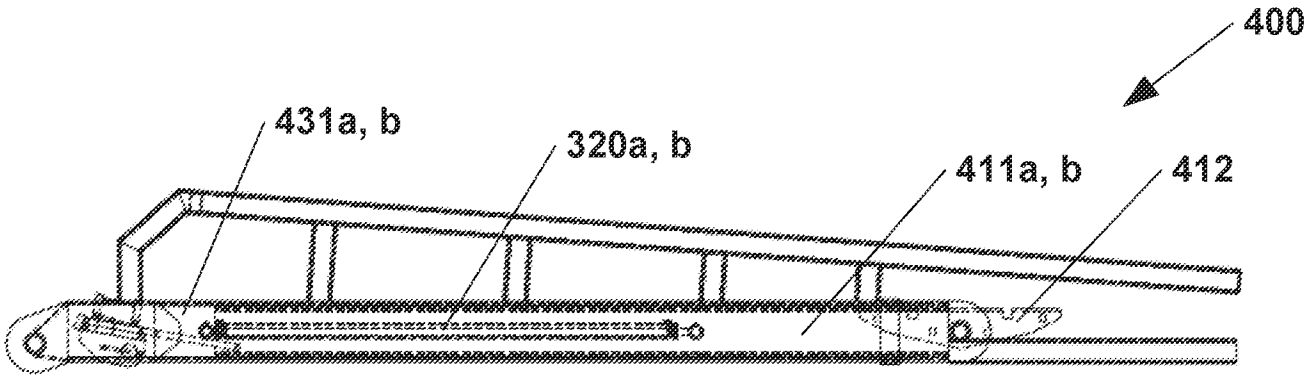
Figure 6D:
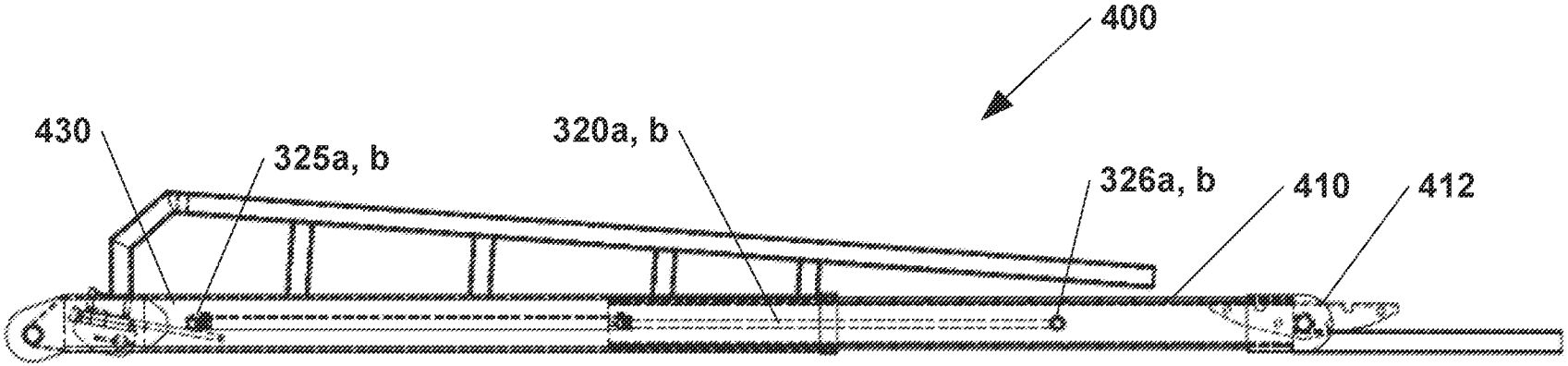

An example of a suitable lift cylinder 330 is of the type having the following specifications: dual acting cylinder with an 8 inch bore, 18.375 or 30 inch stroke length, 5,000 psi rating, 2.5 inch diameter pins and 34.375 or 46 inch retract length. As shown in FIG. 5D, lift cylinder 330 pivotably connects to frame 14 at lug 451 and to truss outer truss 430 at lug 452. As the lift cylinder 330 extends, it causes the outer truss 450 to rotate until it is fully extended and the outer truss 430 is perpendicular to the trailer frame As shown specifically in FIGS. 3C, 4C, and 5C, the second stage of elevation is accomplished by extension of a first portion of travel height truss 400, inner height carriage 410, telescopically away from its prior position within a second portion of travel height truss 400, namely outer truss 430. Thus, inner height carriage 410 extends from outer truss 430 vertically above the horizontal plane of frame 14. In the position illustrated in FIGS. 3C, 4C, and 5C, one or more internal travel height cylinders (discussed below) have expanded within outer truss 430 to extend inner height carriage 410 away from outer truss 430 vertically above the horizontal plane of frame 14. The combined motion causes boom 200 to rise vertically even further upward, while maintaining a desired distance from the rear of trailer 10' despite its increased height above trailer 10'.

Referring in addition to FIGS. 6A-6D, in the embodiment illustrated, the travel height truss 400 includes two components, an outer truss 430 and an inner height carriage 410, telescopically or slidingly attached to each other so that the inner height carriage 410 may extend from within the outer truss 430. When fully collapsed together, inner height carriage 410 is essentially within outer truss 430, and thus travel height truss 400 as a whole may pivot with respect to frame 14 as discussed above. The end of outer truss 430 opposite the pivot point (at shaft 413) represents mount 412 which pivots around shaft 413 so that it may be used to connect travel height truss 400 to boom 200 despite the increase in the angle boom 200 makes with the frame 14. The use of a truss which extends to a greater length changes the location of the pivot point, as opposed to use of a fixed-length truss which only adjusts the pivot point along the length of that set length of the truss.

To achieve the increase in truss size, travel height truss 400 may include one or more dual acting hydraulic travel height cylinders 320*a* and 320*b* to the inner height carriage 410 relative to the outer truss 430. In the preferred embodiment illustrated in the figures, outer truss 430 comprises a pair of parallel, at least partially hollow rails 431*a* and 431*b*, such as may be fabricated from rectangular tubing or channel. Similarly, inner height carriage 410 comprises a pair of parallel hollow slides 411*a* and 411*b*, each of which is shaped and sized to fit within its corresponding hollow rail 431*a*, 431*b*. Each pair of rails 431*a*, 431*b* and slides 411*a*, 411*b* is connected by a cylinder, e.g., rail 431*a* is connected by travel height cylinder 320*a* to slide 411*a*. The connections are by pins 325*a*, 325*b* (where the cylinders connect to the hollow rails) and pins 326*a*, 326*b* (where the cylinders connect to the hollow slides). When assembled and contracted, the travel height cylinders 320*a*, 320*b* lie wholly within their corresponding outer rails and almost entirely with their corresponding inner slides, as shown best in FIG. 6C. When expanded, travel height cylinders 320*a*, 320*b* extend, creating a "longer" truss which causes first portion 201 of the boom 200 to move upwards without affecting the boom position forward or rearward.

An example of a suitable travel height cylinder 320 is of the type having the following specifications: dual acting cylinder having a 2 inch bore, 72 inch stroke length, 3,000 psi, 1.5 inch pin diameter and 80 inch retract length.

To reduce friction between the outer surfaces of inner slides 411*a*, 411*b* and the inner surfaces of outer rails 431*a*, 431*b*, one or more outer surfaces of inner slides 411*a*, 411*b* may be provided with slides 420, which may be a material such as steel, polytetrafluoroethylene (known by the tradename Teflon®), ultra-high molecular weight plastic, steel, or the like provided friction is reduced. In one embodiment, one slide 420 is fastened to at least one of the first and second sides 411*a* and 411*b* of the inner height carriage 410 to reduce sliding friction between the outer truss 430 and the inner height carriage 410.

To connect travel height truss 400 with boom 200, a mount 412, also referred to as a "pivotable brace", is provided at the ends of rails 411*a*, 411*b*, pivoting around pins or shaft 413 to accommodate the variable angle that boom 200 makes with frame 14. The brace that pivotably connects the inner height carriage to the boom is located at a fixed point that is between the first and second portions/ends of the boom, and closer to the second portion/end of the boom. Alternatively, the fixed point is closer to the first end of the frame when the boom and travel height truss are in a lowered rest position. It is also preferred to include as part of inner height carriage 410 a pair of laterally spaced pipe guides 414*a*, 414*b*, which extend from the inner height carriage away from the outer truss, and thus move with height adjustment carriage 410. As shown in FIG. 3C, pipe guides 414*a*, 414*b* are long enough to extend above boom 200 to help keep the pipe sections carried by boom 200 from coming out of boom 200 at all heights.

The disclosure above provides a method of operating a trailer including providing a trailer in a transport arrangement, the trailer having a frame with first and second sides as well as an axle supporting a plurality of wheels. In addition, the trailer includes a boom which may be raised from the trailer and is used to move a pipe from the trailer to a storage or other location. The boom is raised and lowered by a hydraulic system comprising a travel height truss. The travel height truss may comprise two portions, telescopically connected to each other, one portion pivotably connected to the frame and the other pivotably connected to the boom. Two independently controllable hydraulic cylinder systems control the motion of the travel height truss. One cylinder system telescopically connects between each of the two portions of the travel height truss, and the other cylinder is pivotably connected between one of the portions and the frame of the trailer.

The disclosure above also provides a method of raising a boom for moving an oil drilling pipe. The method includes providing an apparatus including a frame and a travel height truss pivotably mounted to the frame. The travel height truss includes an outer truss having first and second ends, at least two partially hollow outer rails, and a lift cylinder. The outer truss is pivotably connected to the trailer frame such that extension of the lift cylinder causes the second end of the outer truss to pivot upwardly with respect to the first end of the outer truss. The travel height truss is also provided with an inner height carriage having a first side and a second side, the inner height carriage being slidingly positioned within the outer truss. The travel height truss further includes at least one travel height cylinder having a first end and a second end. Hydraulic expansion of the travel height cylinder causes the inner height carriage to slidingly extend outwardly from the outer truss. An end of the boom is pivotably connected to the frame. The inner height carriage is pivotably connected to another portion of the boom.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. An apparatus comprising:

a frame having a first end and a second end;

a boom connected to the frame, the boom having a first portion that can be vertically elevated relative to the frame and a second portion that is pivotably connected to the frame and which remains generally in place vertically relative to the frame;

a travel height truss including:

an outer truss having first and second ends and further including at least two partially hollow outer rails, the outer truss being pivotably connected to the second end of the frame such that extension of a lift cylinder causes the second end of the outer truss to pivot upwardly with respect to the first end of the outer truss;

an inner height carriage slidingly positioned within the outer truss and having a first side and a second side, and a first end that is adjacent the outer truss and a second end that is adjacent the boom; and at least one travel height cylinder having a first end and a second end, in which hydraulic expansion of the travel height cylinder causes the inner height carriage to slidingly extend outwardly from the outer truss;

wherein the second end of the inner height carriage is pivotally connected to the boom at a fixed point by a brace, and the second side of the inner height carriage comprises at least one pipe guide which extends from the inner height carriage in a direction away from the outer truss.

2. The apparatus of claim 1, in which the outer truss comprises rails fabricated of rectangular tubing or channel.

3. The apparatus of claim 2, in which the outer truss comprises two rails parallel to each other.

4. The apparatus of claim 1, wherein the inner height carriage further comprises at least one slide fastened to at least one of the first and second sides of the inner height carriage to reduce sliding friction between the outer truss and the inner height carriage.

5. The apparatus of claim 4, wherein at least one slide comprises one of the group consisting of polytetrafluoroethylene, plastic, steel, and ultra high molecular weight material.

6. The apparatus of claim 1, wherein the first end of the travel height cylinder is pinned onto the outer truss and the second end of the travel height cylinder is pinned onto the inner height carriage.

7. The apparatus of claim 1, wherein the frame includes at least one axle and wheels connected to each axle.

8. The apparatus of claim 1, the boom being supported by the travel height truss.

9. The apparatus of claim 8, wherein the boom is configured to support a pipe section.

10. A method of raising a boom for moving an oil drilling pipe, the method comprising:

providing an oil drilling pipe;

providing an apparatus including, a frame having first and second sides and first and second ends;

a travel height truss pivotably mounted to the first end of the frame, wherein the travel height truss includes an outer truss having first and second ends, at least two partially hollow outer rails, and a lift cylinder, wherein the outer truss is pivotably connected to the frame such that extension of the lift cylinder causes the second end of the outer truss to pivot upwardly with respect to the first end of the outer truss; and a boom for moving the oil drilling pipe, the boom having a first portion that is raised to move the oil drilling pipe, and a second portion that is pivotably connected to the frame near the second end of the frame;

providing the travel height truss with an inner height carriage having a first side and a second side, the inner height carriage being slidingly positioned within the outer truss;

providing the travel height truss with at least one travel height cylinder having a first end and a second end, in which hydraulic expansion of the travel height cylinder causes the inner height carriage to slidingly extend outwardly from the outer truss; and pivotably connecting the inner height carriage to a portion of the boom at a fixed point with a pivotal brace, wherein the fixed point is a point other than the end of the boom, the fixed point being closer to the first end of the frame than the second end of the frame when the boom and travel height truss are in a lowered rest position.

* * * * *